United States Patent [19]

Hans

[11] Patent Number: 4,817,676

[45] Date of Patent: Apr. 4, 1989

[54] LOOM SHEDDING MOTION

[75] Inventor: Peter Hans, Winterthur, Switzerland

[73] Assignee: Sulzer Brothers Limited, Winterthur, Switzerland

[21] Appl. No.: 63,475

[22] Filed: Jun. 18, 1987

[30] Foreign Application Priority Data

Jul. 4, 1986 [CH] Switzerland ..... 02721/86

[51] Int. Cl.[4] ..... D03C 13/00

[52] U.S. Cl. ..... 139/57; 139/79; 139/82

[58] Field of Search ..... 139/79, 80, 81, 82, 139/55.1, 56, 57, 66; 74/469, 471 R, 479

[56] References Cited

U.S. PATENT DOCUMENTS 889,971 6/1908 Salisbury ..... 139/57

4,005,736 2/1977 Pfarrwaller ..... 139/79

*Primary Examiner*—Henry S. Jaudon

*Attorney, Agent, or Firm*—Burns, Doane, Swecker & Mathis

[57] ABSTRACT

In a loom shedding motion device, the pivoting motion of cam follower levers driven by cams is transmitted by way of thrust rods, bent levers to the leaves of the loom. Extending from a central bearing of each lever are arms on the motion input side of the lever and the motion output side of the lever. The arms are cranked or offset relatively to a bearing lug of the bent lever so that pivot points or arrangements at the ends of the arms and a center bearing are disposed substantially on a straight line, so that, because of the transmission forces in the shedding motion, the pivot experience torques which are operative around the bearing center and whose resultant is disposed vectorially on the bearing axis. The bent levers are therefore supported on the spindle or bearing shaft without tilting, so that the operation is free from wear and little lubricant is needed.

3 Claims, 2 Drawing Sheets

LOOM SHEDDING MOTION

BACKGROUND AND SUMMARY OF THE INVENTION

The invention relates to a loom shedding motion in which a number of cams are secured to a shaft and adapted to drive pivoted cam follower levers. Thrust rods are connected thereto and pivoted bent levers are connected to the thrust rods. The bent levers have a central bearing, one arm on their input side and one arm on the bearing of the bent lever. Motion-transmitting pivots are positioned at the ends of the arms The normal practice in modern shedding motions is to provide two cams to drive a single cam follower lever, so that the shedding elements of the loom are positively driven in both directions of movement. The space required axially of the drive shaft to accommodate a pair of cams and a cam follower lever is greater than the space required at the output end pivots of the bent levers in the direction of the pivot axes. Relatively slender elements for transmitting the motion to the leaves of the loom are positioned in the pivots. The spacing between the leaves, i.e., the distance between the center plane of any leaf and the center plane of an adjoining leaf, is normally the same as the spacing between the pivots at the output ends of the bent levers. Since the spacing between the cam follower levers in the shedding motion is greater than the spacing between the bent levers at their output ends, the bent levers of prior art shedding motions are provided with crank or offset portions in one of their arms. The crank or offset portions extend between the bearing of the bent lever and the output end pivot. The degree of offset or crank is greater in proportion to the distance the bent lever is from the center of a group of adjacent levers of a shedding motion. An arrangement of this kind is known, for example, from German patent specification No. 2 441 353. In this known construction there is a considerable axial offset between the bearing and the output end pivot of the outer arms of a lever group. In comparison, the axial offset between the pivots where the thrust rods are connected and the bearings of the bent levers is negligibly small at the input end of the opposite arms of the bent levers. Because of the relatively substantial crank or offset of the lever arms which extend to the output end, the reaction forces produced by the transmission elements of the shedding motion producing high bending moments which may lead to excessive tilting of the bearings of the bent levers and therefore to overstressing of the spindle carrying such levers or in the bearings.

It is the object of the invention to provide a device producing a shedding motion obviating tilting excessive in the bearings of the bent levers.

According to the invention, the arms are so cranked or offset that, as seen in a view perpendicular to their bearing axis, the group of the bent levers has a fan shape in which the distance from one pivot to the other at the output end is less than the distance from one bearing center to the other and the distance from one bearing center to the other is less than the distance from one pivot to the other at the input end. In this arrangement, the angles between the connecting lines, from the centers of the pivots of any lever to the center of the same lever bearing may differ by at most 8°. Ideally these connecting lines form a straight line. In every case, there are in each group of levers distances equal between adjacent pivots at the input of the bent levers, and equal spacings between their bearings and also equal spacings between adjacent output end pivots. The connecting lines form with the axis of the bent levers an angle of about 90°. The angles decrease from the center of the whole group of levers towards the outside of the group of levers by a reduced amount of from 1° to 5°.

The bent levers according to the invention in particular operate with very reduced wear and require little lubricant.

BRIEF DESCRIPTION OF THE DRAWINGS

The invention will be described in greater detail hereinafter with reference to the drawings wherein.

DETAILED DESCRIPTION OF THE INVENTION

Figure 1:
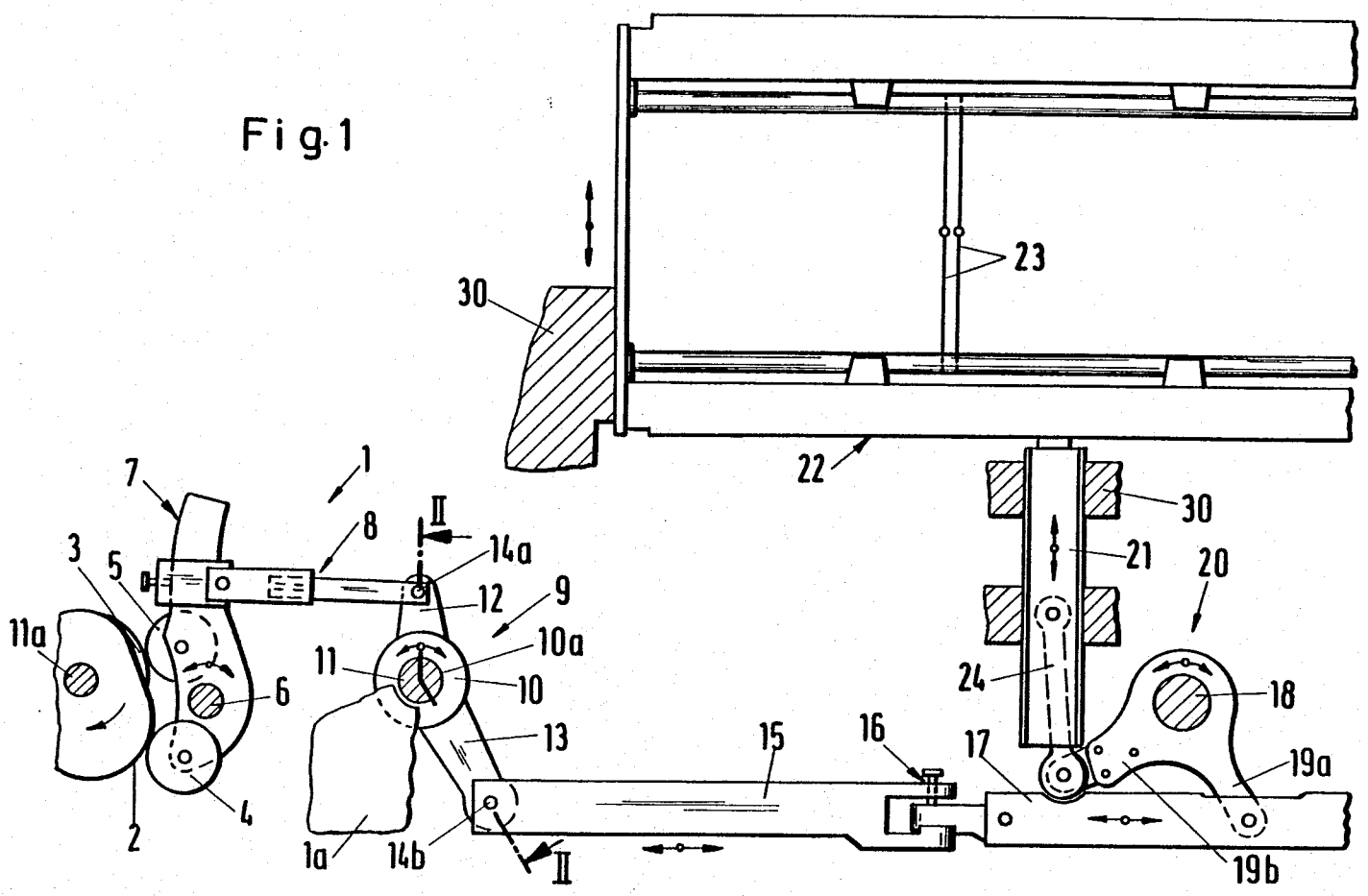
FIG. 1 shows one line or strand of the shedding motion with the elements for transmitting motion to the leaf of a loom.

A shaft 11*a*, a spindle 6 of cam follower leavers 7 and a spindle 11 of bent levers 9 are mounted in casing 1*a* of a shedding motion producing drive 1. A main drive (not shown) of the loom 30 drives a shaft 11*a* on which a number of cams 2, 3 for the levers 7 are located. Cam follower roller 4 of an individual lever 7 is engaged and driven by cam 2 and cam follower roller 5 of the same lever 7 is engaged and driven by a complementary cam 3. Rotation of the drive shaft 11a pivots the levers 7, which are positioned in a row, one beside another, around the spindle 6 as indicated by the double arrow. Thrust rods 8 transmit the motion from the levers 7 to the bent levers 9. An arm 12 extends from a central bearing or bearing lug 10 to a pivot point 14*a* at the input end of the bent lever 9 and an arm 13 extends to a pivot 14*b* at the output end of the bent lever 9. Pivot points 14*a* and 14*b* constitute motion transmitting pivot means. A thrust rod 15 is pivotedly connected to the output end pivot 14b and is rigidly connected by a coupling 16 to a reciprocating arm 17 which might also oscillate as a result of vibrations in the loom. The reciprocating movement of the arm 17 is transmitted by a bent lever device 20 having arms 19*a* and 19*b* to lift rod 24 in a lifter 21. Levers 20 are mounted on a spindle 18 in the loom. Leaves 22 are rigidly coupled with the lifters 21 and heddles 23, for shedding the warp yarns of the loom 30, are hung in the leaves 22.

Figure 2:
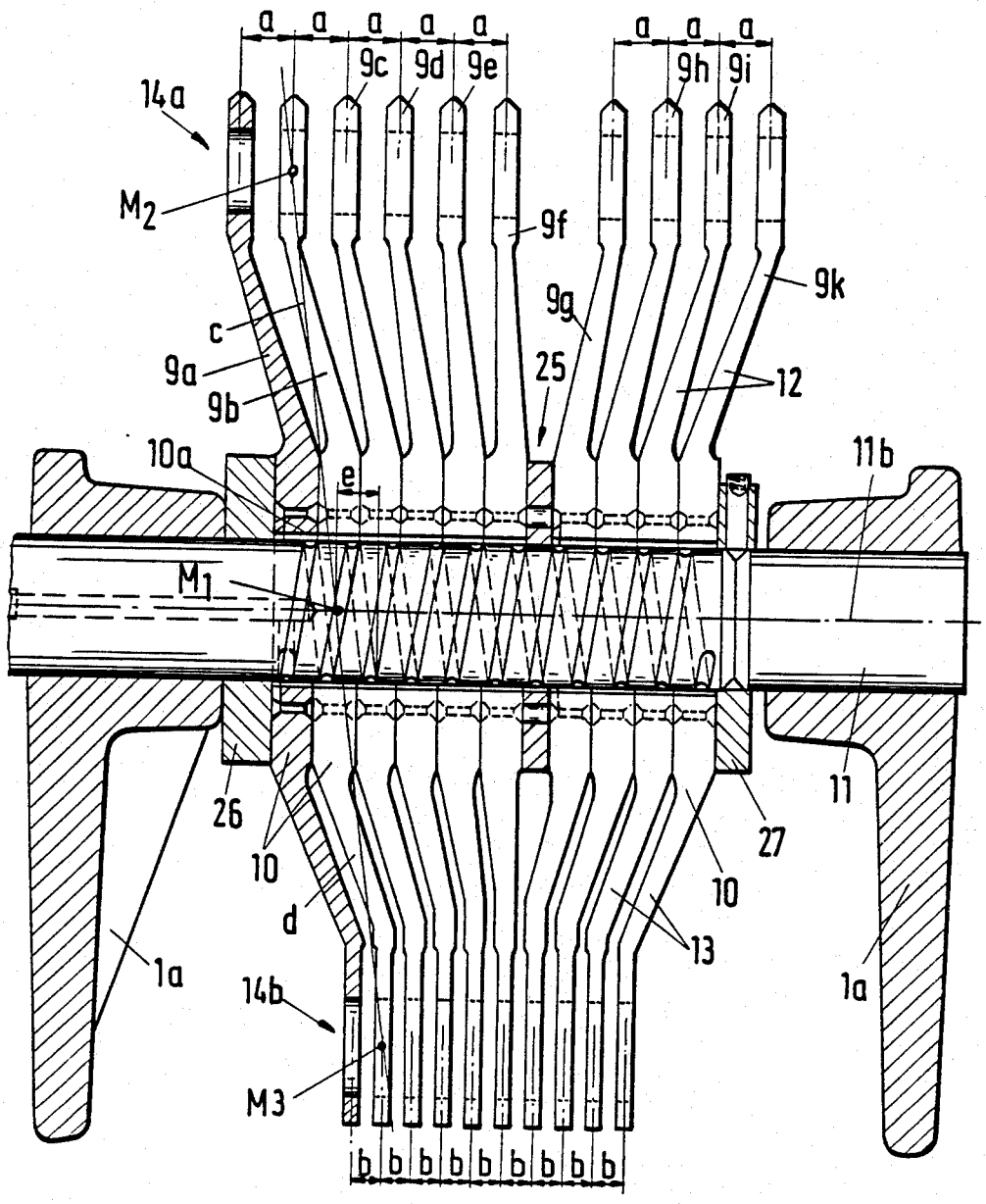
FIG. 2 is a section along the line II—II of FIG. 1 through the bent levers of the shedding motion producing device.

In the cross-section shown along line II—II of FIG. 1 and in FIG. 2, the full length of the spindle 11 for the bent levers 9 is shown. The spindle 11 is in the casing 1*a*. End discs 26, 27 are positioned between the casing 1*a* and the bent levers 9*a*, 9*b* . . . 9*k*. The bent levers 9, when viewed as a group and perpendicular to the bearing axis 11*b*, define a fan shape. As seen in FIG. 2, the levers 9 to the left of member 25 which are bent, are bent in a direction different from the levers 9 that are located to the right of number 25. The spindle 11 is supported in the casing 1*a* by an intermediate bearing and spacer member 25. The section shown along the line II—II of FIG. 1 is such that the arms 12, 13 of the bent levers 9 are pivoted around the bearing axis 11b with the axes of the pivots 14*a*, 14*b* being positioned together with the bearing axis 11b of the bent levers 9, in the plane of FIG. 2. As shown, the connecting lines between, on the one hand, centers $M_2$ and $M_3$ of the pivots 14*a*, 14*b* and, on the other hand, the center $M_1$ of a bearing lug 10 of bent lever 9*b* form a straight line. Because of the described geometrical arrangement, the angles of the connecting lines c and d, between the pivot centers $M_2$, $M_3$ and the lug centers $M_1$, differ only slightly from 90. This permits the arms of the bent levers to be relatively slender. That is, since the angles of the connecting lines c and d differ only slightly from 90°, the torque produced in the bent levers 9 is less than it would be if the connecting lines c and d differed substantially from 90°. Since there is less torque produced, relatively slender bent levers can be employed. Lubrication conduits are shown by dotted lines. As seen in FIG. 2, a spiral is provided on shaft 11 and grooves are provided on the surfaces of the bearings 10 of the bent levers 9. Thus, lubrication can be applied to a single place on the spiral or the groove so as to lubricate all of the bent levers 9.

As depicted in FIG. 2, the spacing b between the center $M_3$ of adjacent pivot means at the motion output end is less than a distance e from one bent lever bearing center $M_1$ to an adjacent bent lever bearing center $M_1$ and that latter distance e is less than the spacing a between the center $M_2$ of adjacent pivot means at the motion input ends.

The principles, preferred embodiments and modes of operation of the present invention have been described in the foregoing specification. The invention which is intented to be protected herein should not, however, be construed as limited to the particular forms disclosed, as these are to be regarded as illustrative rather than restrictive. Variations and changes may be made by those skilled in the art without departing from the spirit of the present invention. Accordingly, the foregoing detailed description should be considered exemplary in nature and not limited to the scope and spirit of the invention as set forth in the appended claims:

I claim:

1. A device providing a loom shedding motion having a predetermined number of cams connected to a drive shaft means for driving a plurality of pivoted cam follower levers, first thrust rods connected to the follower levers and to pivotally mounted bent levers, each of said bent levers comprising two arms supported on a central bearing and being offset with respect to said central bearing, said central bearing having a bearing center, one arm of the bent levers being on a motion input end and another arm on a motion output end, motion-transmitting pivot means located at the motion input and motion output ends of the arms for connecting said input end with said first thrust-rod and said output end with a second thrust rod, the arrangement of the levers being such that, when viewed as a group perpendicular to a bearing axis of the arms, the bent levers have a fan shape in which a spacing (b) between the center of adjacent pivot means at the motion output end is less than a distance e from one bent lever bearing center to an adjacent bent lever bearing center and said distance is less than a spacing (a) between the center of adjacent pivot means at the motion input end, whereby connecting lines from the centers of the pivot means of any one of said bent levers to the bearing center of the same bent lever define angles with respect to a centerline of the central bearing which differ by at most 8°.

2. A shedding motion device according to claim 1, wherein the amount of the spacings (a), the amount of the spacings (b) and the amount of the distances (e) defined between the centerline of the adjacent bent layers at the centerline of the central bearing are constant and wherein a straight connecting line can pass through the center of the pivot means at the motion input end, the center of the pivot means at the motion output end and the bearing center.

3. A shedding motion device according to claim 1, wherein the angles between the connecting lines and the centerline of the bearing vary by an amount of from 1° to 5° between the adjacent bent levers as considered in the direction outward from the center of the whole group of bent levers.

* * * * *

UNITED STATES PATENT AND TRADEMARK OFFICE

CERTIFICATE OF CORRECTION

PATENT NO. : 4,817,676

DATED : Apr. 4, 1989

INVENTOR(S) : Hans PETER

It is certified that error appears in the above-identified patent and that said Letters Patent is hereby corrected as shown below:

Item No. [75] "Inventor: Peter Hans, Winterthur, Switzerland" should read:

Item No. [75] --Inventor: Hans PETER, Winterthur, Switzerland.--

Item No. [19] "Hans" should read -- Peter --.

Signed and Sealed this

Twenty-sixth Day of September, 1989

*Attest:*

*Attesting Officer*

DONALD J. QUIGG

*Commissioner of Patents and Trademarks*